US005170850A

United States Patent [19]

Sassak, II

[11] Patent Number: 5,170,850

[45] Date of Patent: Dec. 15, 1992

[54] RATCHET OPERATED DEVICE FOR SETTING A POST HAVING AN AUGER ATTACHED AT ONE END

[76] Inventor: John Sassak, II, 1528 Commerce Pines Dr., Walled Lake, Mich. 48390

[21] Appl. No.: 879,182

[22] Filed: May 5, 1992

Related U.S. Application Data

[63] Continuation of Ser. No. 731,200, Jul. 16, 1991, abandoned.

[51] Int. Cl.[5] ..... E02D 7/22

[52] U.S. Cl. ..... 173/18; 81/33; 405/232

[58] Field of Search ..... 173/18; 81/30, 31, 33, 81/29, 177.1; 52/157; 405/232, 244

[56] References Cited

U.S. PATENT DOCUMENTS

| | | | |
|---|---|---|---|
| 304,102 | 8/1884 | Herman | 81/33 |
| 810,409 | 1/1906 | Heard | 81/33 |
| 1,176,605 | 3/1916 | Schad . | |
| 1,212,481 | 1/1917 | Hall | 81/33 |
| 1,800,504 | 4/1931 | Chance . | |
| 1,897,854 | 2/1933 | Myers et al. | 81/33 |
| 2,234,398 | 3/1941 | Ciaccio | 81/33 |
| 3,830,315 | 8/1974 | Love | 173/26 |
| 4,653,245 | 3/1987 | Webb | 52/749 |

*Primary Examiner*—Frank T. Yost
*Assistant Examiner*—Scott A. Smith
*Attorney, Agent, or Firm*—Charles W. Chandler

[57] ABSTRACT

Ratchet operated device for setting a post having a helical auger thread disposed at one end. The ratchet operated device has an annular sleeve with an annular series of teeth disposed on its exterior surface. The annular sleeve is provided with a fastener for securing the annular sleeve to the post. A collar coaxially fits over the annular sleeve such that it circumscribes the annular series of teeth. Attached to the collar is a handle, preferably one that is removable to facilitate transporting and storing. Radially extending through the collar is a bore in which there is disposed a ratchet mechanism. The ratchet mechanism has a pawl which is biased to engage the annular series of teeth. The profile of the pawl provides positive engagement of the pawl with the annular series of teeth when the collar is rotated in one direction, while providing an overrunning action when the collar is rotated in the opposite direction. The pawl is rotatable between a first position and a second position such that the ratchet operated device is able to both install and remove a post from the ground by reversing the position of the pawl.

5 Claims, 2 Drawing Sheets

RATCHET OPERATED DEVICE FOR SETTING A POST HAVING AN AUGER ATTACHED AT ONE END

This application is a continuation of application Ser. No. 07/731/200, filed Jul. 16, 1991, now abandoned.

BACKGROUND OF THE INVENTION

1. Field of the Invention

The present invention generally relates to devices for setting posts in the ground. More specifically, this invention relates to a ratchet operated device for setting a post having a helical anchor attached to one end, such as a post for supporting a marine dock.

2. Description of the Prior Art

Conventionally, posts are set in the ground by first digging a post hole, setting the post within the hole, and then again filling the hole with dirt. To provide adequate lateral support to the post, it is necessary to continuously pack the dirt around the post as the dirt is replaced. Such a method, though requiring . considerable effort, is adequate under most conditions. Where the soil is difficult to dig as a result of the soil being compacted or having many rocks, augers such as that taught by U.S. Pat. No. 1,176,605 which issued Mar. 21, 1916 to Schad have been used to dig the post hole. To improve the operation of the auger, Schad teaches forming the handle with a ratchet mechanism which provides positive engagement between the handle and the auger as the auger is rotated when digging the hole. When the handle is rotated in the opposite direction, the ratchet mechanism provides overrunning—i.e. no positive engagement occurs such that the handle can be rotated without effecting the auger. However, where the post is to be set in the water, the conventional method of digging a hole for setting the post is impractical.

In the art pertaining to ground anchors, it has been previously suggested to provide an anchor rod with helical threads at one end to act as an auger. As a result, the anchor rod itself produces its own hole in the ground Examples of this approach include U.S. Pat. No. 1,800,504 which issued Feb. 4, 1929 to Chance and U.S. Pat. No. 4,653,245 which issued Mar. 31, 1987 to Webb. The anchor devices taught by Chance and Webb both require significant manual effort in order set an anchor rod in the ground. Consequently, the effort necessary to set a post, which typically has a larger diameter than an anchor rod, would be substantially greater.

A solution to this problem is taught in U.S. Pat. No. 3,830,315 which issued Aug. 20, 1974 to Love. In addition to providing a helical auger at one end of the anchor rod, Love automates the rotary power necessary to rotate the anchor rod into the ground by providing a helical drive gear which drives a worm gear on the perimeter of the rod. However, the solution taught by Love is not appropriate when setting posts offshore for a marine dock because the helical drive gear requires a significant rotary power source, such as the power take off of a tractor.

Therefore, what is needed is a manually operated device which can be readily used to set posts under such circumstances as off shore locations for marine docks and in rocky or compacted soil.

SUMMARY OF THE INVENTION

The present invention provides a ratchet operated device for setting a post having a helical auger thread disposed at one end. Of primary importance, the ratchet operated device of the present invention is capable of reducing the effort required to set a post in the ground, particularly where it is difficult or impractical to provide a hole for the post. In addition, the ratchet operated device is capable of removing such a post from the ground. This feature is desirable where the post is used to support a marine dock. Typically, such a post is set in the water at the beginning of the warm season, and is then removed along with the marine dock prior to the winter freeze in order to prevent damage to the post and the marine dock.

In particular, the ratchet operated device of the present invention has an annular sleeve with an annular series of teeth disposed on its exterior surface. The annular sleeve is provided with a fastener, such as a pin, for securing the annular sleeve to the post through pairs of corresponding apertures in both the annular sleeve and the post. A collar coaxially fits over the annular sleeve such that it circumscribes the annular series of teeth. Attached to the collar is a handle, preferably one that is removable to facilitate transporting and storing. Radially extending through the collar is a bore in which there is disposed a ratchet mechanism.

The ratchet mechanism has a pawl which is biased radially inwardly through the collar to engage the annular series of teeth. The pawl has a saw-tooth profile which provides positive engagement of the pawl with the annular series of teeth when the collar is rotated in one direction, while providing an overrunning action (i.e. no positive engagement between the pawl and the teeth occurs) when the collar is rotated in the opposite direction. As a result, the pawl is able to transmit torque between the collar and the annular sleeve, and thus the post, when the collar is rotated in the first direction.

In the preferred embodiment of the present invention, the pawl is rotatable between a first position and a second position within the radial bore of the collar. Accordingly, the pawl is able to transmit torque between the collar and the annular sleeve when the pawl is in the first position and the collar is rotated in one direction, while the pawl is also able to transmit torque between the collar and the annular sleeve when the pawl is in the second position and the collar is being rotated in the opposite direction. Accordingly, with the annular sleeve secured to a post, the ratchet operated device can be used to both install and remove the post from the ground by reversing the position of the pawl within the radial bore.

Accordingly, it is an object of the present invention to provide a device for setting a post in the ground without the need to first dig a hole. The present invention accomplishes this object by providing a device which is used in conjunction with a pole having a helical auger thread disposed at one end.

It is a further object of this invention to provide a pole setting device which utilizes a ratchet mechanism for rotating the pole, thus providing the auger-action needed for the pole to set itself in the ground.

It is still a further object of this invention to provide a ratchet operated mechanism which can be selectively switched to either install a pole in the ground, or alternatively, remove the pole from the ground through a ratchet action.

It is yet a further object of this invention to provide a ratchet operated mechanism which is adapted for use with marine posts which are set in water and which are provided with diametrical apertures for securing a dock thereto.

Other objects and advantages of this invention will be more apparent after a reading of the following detailed description taken in conjunction with the drawings provided.

DESCRIPTION OF THE DRAWINGS

The description refers to the accompanying drawings in which like reference characters refer to like parts throughout the several views, and n which.

DETAILED DESCRIPTION OF THE PREFERRED EMBODIMENT

Figure 1:
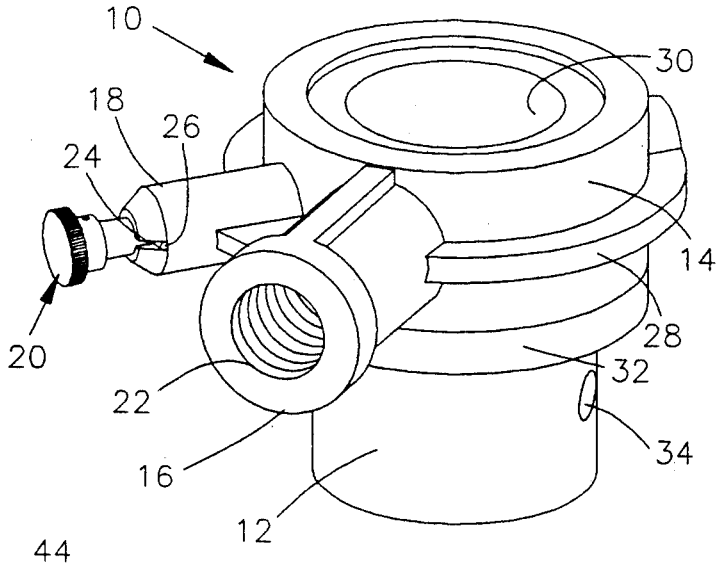
FIG. 1 is a side elevational view of an ratchet operated device according to the preferred embodiment of the present invention.
Figure 2:
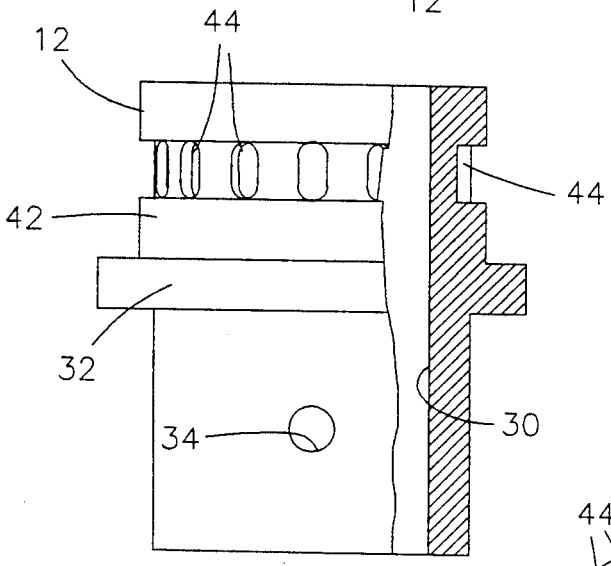
FIG. 2 is a partial cross-sectional view of the annular sleeve of FIG. 1.
Figure 5:
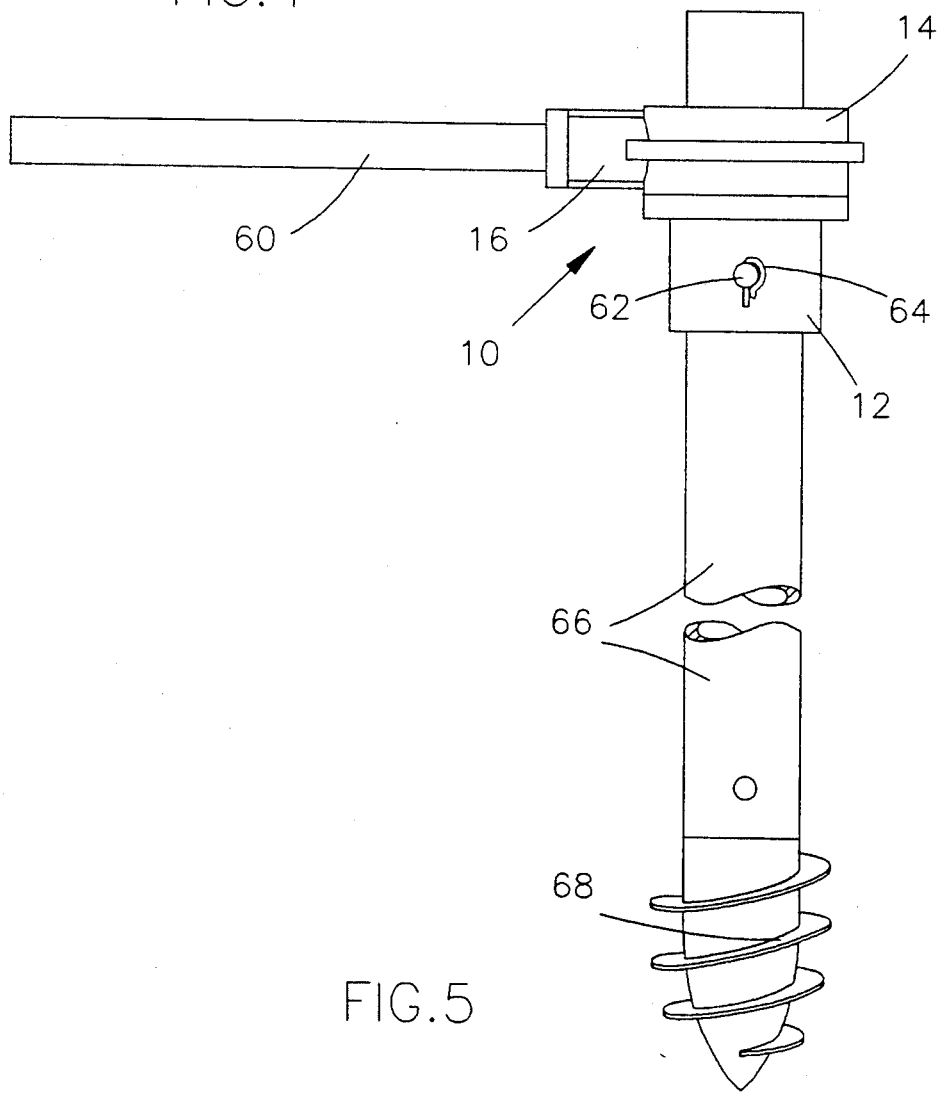
FIG. 5 is an elevational view of the ratchet operated device of FIG. 1 as it is assembled to a marine dock post according to the preferred embodiment of the present invention.

Referring to FIGS. 1 and 5, there is provided a ratchet mechanism assembly 10 for setting a post, such as a marine dock pst 66, having a helical anchor or auger 68 at one end. Post 66 is provided with a diametrical aperture (not shown) through which a pin 62 is disposed for securing ratchet mechanism assembly 10 thereto. Ratchet mechanism assembly 10 includes an annular sleeve 12 through which a sleeve bore 30 extends longitudinally. Annular sleeve 12 can be formed of any suitably rigid material with sufficient strength to perform the operations that will be described below. In practice, aluminum has been found to be a suitable material. As best seen in FIG. 2, annular sleeve 12 has a enlarged diameter portion 42 at one end upon which is formed an annular series of ratchet teeth 44. Ratchet teeth 44 are oriented to be disposed longitudinally on annular sleeve 12. At the opposite end of annular sleeve 12 there is provided a pair of diametrically opposed apertures 34 and 35 which correspond to the aperture provided in post 66. Located between ratchet teeth 44 and apertures 34 and 35 is a radially extending shoulder 32.

With reference again to FIG. 1, an annular collar 14 is positioned externally to and coaxially with annular sleeve 12. As with annular sleeve 12, collar 14 can be formed of any suitably rigid material, such as aluminum. An internal bore 50 of annular collar 14 circumscribes enlarged diameter portion 42 and ratchet teeth 44 such that collar 14 abuts shoulder 32 of annular sleeve 12. Preferably, collar 14 is provided with a reinforcement rib 28 which provides added strength, particularly in torsion. Extending radially from collar 14 is a first cylindrical extension 16 and a second cylindrical extension 18 which is angularly displaced from the first. As seen in FIG. 1, first cylindrical extension 16 is provided with a threaded bore 22 into which a handle 60 can be threadably secured, as shown in FIG. 5.

Figure 3:
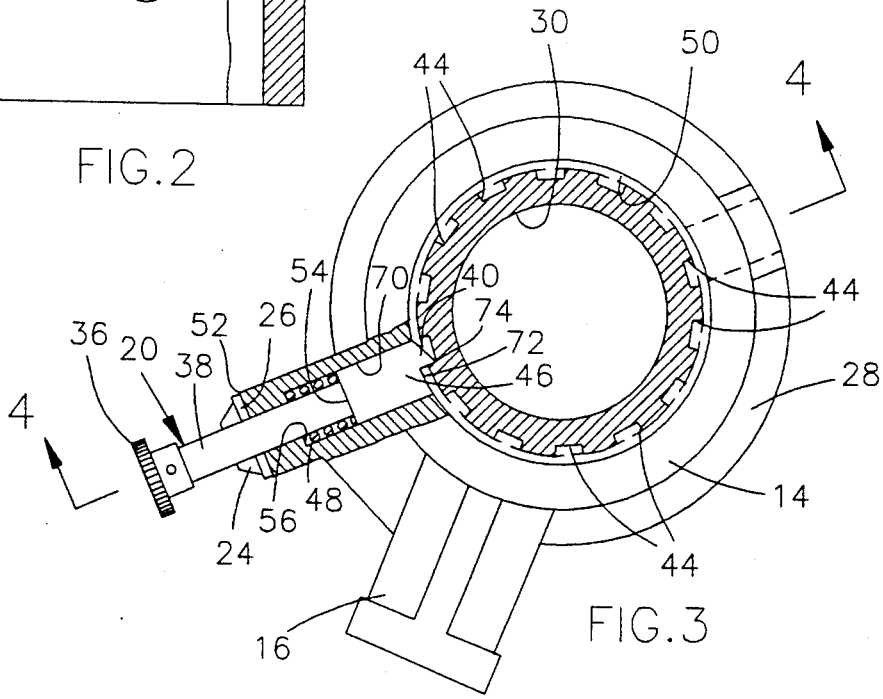
FIG. 3 is a partial cross-sectional view of the collar of FIG. 1.
Figure 4:
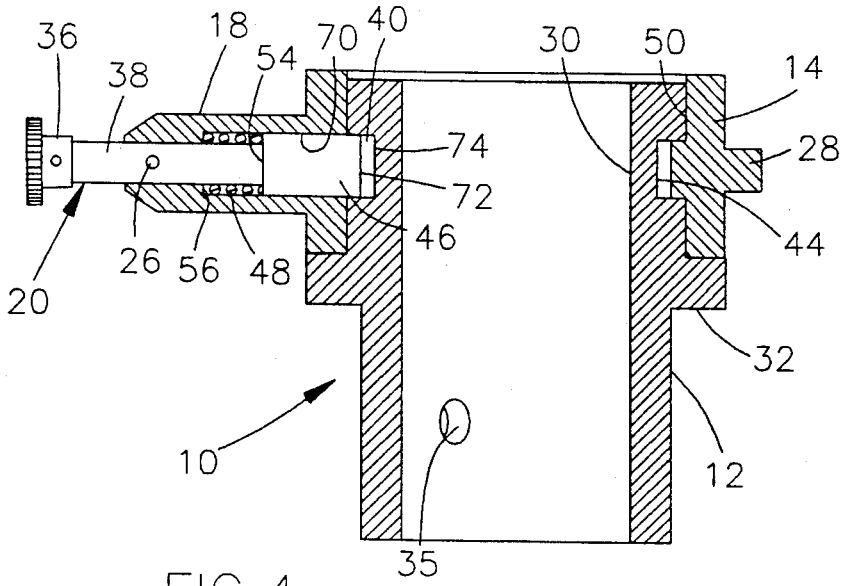
FIG. 4 is a cross-sectional view of the collar of FIG. 3 taken along line 4—4, and including a cross-sectional view of the annular sleeve of FIG. 2 as assembled with the collar.

With reference to FIGS. 3 and 4, cylindrical extension 18 is provided with a radial bore 70 in which a spring loaded pawl 20 is disposed. Cylindrical extension 18 is formed with a slot 24 and a slot shoulder 52 which cooperate with a pin 26 disposed diametrically through pawl 20 to limit the rotation and radially inward travel, respectively, of pawl 20. Pawl 20 includes a shaft 38 having a knurled knob 36 at its radially outward end and a pawl tooth 40 disposed at its radially inward end. As best seen in FIG. 3, pawl tooth 40 has a saw-tooth profile in which a radial flat 72 is formed in one hemisphere while the tooth form is formed in the other hemisphere, the crest 74 of pawl tooth 40 being formed on the diameter of enlarged diameter portion 46 which is parallel to the axis of collar 14.

Pawl tooth 40 is formed on an enlarged diameter portion 46 of shaft 38 so as to provide added strength to pawl tooth 40. Enlarged diameter portion 46 forms a pawl shoulder 54 on shaft 38. Correspondingly, radial bore 70 has an enlarged portion to accommodate enlarged diameter portion 46 of shaft 38, such that there is also a bore shoulder 56 formed within bore 70. As shown in FIGS. 3 and 4, bore shoulder 56 is located radially outward from pawl shoulder 54.

Disposed between bore shoulder 56 and pawl shoulder 54 is a biasing member, such as a compression spring 48. Spring 48 acts to bias pawl tooth 40 radially inward while also maintaining pin 26 in engagement with slot shoulder 52. Spring 48 biases pawl tooth 40 against ratchet teeth 44 on annular sleeve 12, as indicated in FIG. 4. The longitudinal displacement between bore shoulder 56 and pawl shoulder 54 is sufficient to allow pawl 20 to be displaced radially outward so as to disengage pin 26 from slot 24. Displacement of pawl 20 is also sufficient to disengage pawl tooth 40 from ratchet teeth 44. For illustrative purposes, ratchet mechanism assembly 10 is shown in FIG. 4 as it would be preferable oriented for mounting to post 66, as indicated in FIG. 5.

The saw-tooth form of pawl tooth 40 maintains positive engagement of pawl tooth 40 with ratchet teeth 44, allowing pawl 20 to transmit torque between collar 14 and annular sleeve 12 when collar 14 is rotated in a first direction. In the reverse direction, pawl tooth 40 overruns ratchet teeth 44, thus providing the desired ratchet action. As noted above, pawl 20 can be pulled radially outward so as to disengage pin 26 from slot 24. Consequently, pawl 20 can be rotated from a first position to a second position, 180 degrees from the first position, which reverses the saw-tooth profile of pawl tooth 40. As a result, when in the second position pawl 20 is able to transmit torque between collar 14 and annular sleeve 12 when collar 14 is rotated the opposite direction to the first direction. Again, pawl tooth 40 overruns ratchet teeth 44 when pawl 20 is in the second position and collar 14 is rotated in the first direction.

For assembly, annular sleeve 12 is slid over the end of post 66 opposite auger 68 such that ratchet teeth 44 face away from auger 68. Apertures 34 and 35 are then aligned with the diametrical aperture (not shown) in post 66, and pin 62 can then be inserted into the aligned apertures and secured with any suitable device, such as a key 64.

When installing collar 14 to the above assembly, pawl 20 must be displaced radially outward such that pawl tooth 40 is withdrawn from collar bore 50. Collar 14 can then be slid over annular sleeve 12 until it rests upon shoulder 32. At this time, pawl 20 can be released to allow pawl tooth 40 to engage one of ratchet teeth 44. Handle 60 can now be installed into threaded bore 22, if not done previously.

In operation, when it is desired to set post 66 into the ground, pawl 20 is rotated to either its first or second position, which ever corresponds to the helical form of auger 68. Typically, auger 68 will be provided with a right hand helical form. Accordingly, pawl 20 should be rotated to provide positive engagement between pawl tooth 40 and ratchet teeth 44 when collar 14 is rotated in a clockwise direction. Collar 14 can then be rotated via handle 60 with a ratchet-type action, causing post 66 to be threadably set into the ground until the desired depth is attained. Ratchet mechanism assembly 10 can then be removed from post 66 by removing pin 62 and sliding ratchet mechanism assembly 10 off the top of post 66. To remove post 66 from the ground, assembly 10 can be simply reinstalled on post 66 as described above, with pawl 20 being rotated to its second position. With a right-handed helical form, the ratchet action of the assembly 10 will threadably remove post 66 from the ground in a counterclockwise direction of rotation.

An advantage to the present invention is that the ratchet action of ratchet mechanism assembly 10 can quickly set post 66 in the ground without the need for first digging a hole for post 66. This is particularly advantageous where post 66 is for supporting a marine dock, and it is therefore impractical or impossible to form a hole into which post 66 can be set. In addition, ratchet mechanism assembly 10 is able to quickly and easily set post 66 into the ground without the need for an external power source. The ratchet action of ratchet mechanism assembly 10 coupled with a sufficient lever length to handle 60 provides an operator with leverage to set post 66 with relative ease. Finally, ratchet mechanism assembly 10 can be quickly removed from post 66, or if necessary, the ratchet action of ratchet mechanism assembly 10 can be reversed to remove post 66 if its location or its depth is determined to be incorrect.

While the invention has been described in terms of a preferred embodiment, it is apparent that other forms could be adopted by one skilled in the art. Accordingly, the scope of the invention is to be limited only by the following claims.

Having described my invention, I claim:

1. A ratchet operated device for setting a post having a helical anchor at one end and a diametrical aperture, the ratchet operated device comprising:

an annular sleeve having an exterior surface, the annular sleeve having an annular series of teeth disposed on the exterior surface adjacent one end of the annular sleeve, the annular sleeve having a pair of diametrically opposed apertures adjacent an opposite end of the annular sleeve, the annular sleeve having a radially extending shoulder between the annular series of teeth and the pair of diametrically opposed apertures, said one end of said sleeve and said shoulder having a radius, wherein the radius of said one end of said sleeve is less than the radius of said shoulder;

an annular collar slidable onto the annular sleeve at one end of the sleeve and movable longitudinally therealong to a location circumscribing the annular series of teeth and abutting the radially extending shoulder, the collar being rotatable on the sleeve at said location and having a radially extending portion with a radial bore disposed therein, the radially extending portion having an abutment surface;

a cylindrical rod disposed within the radial bore, the cylindrical rod having a pawl disposed at a radially inward end, the cylindrical rod having abutment means for providing limited radially inward travel of the pawl;

biasing means for engaging the pawl with the annular series of teeth and engaging the abutment means with the abutment surface, the pawl transmitting torque between the collar and the annular sleeve when the collar is rotated in a first direction, the pawl overrunning the annular series of teeth when the collar is rotated in an opposite direction to the first direction;

handle means secured to the collar, the handle means extending in a substantially radial direction from the collar; and fastener means for releasably securing the annular sleeve to the post, the fastener means engaging the pair of diametrically opposed apertures of the annular sleeve and the diametrical aperture of the post.

2. The ratchet operated device of claim 1 wherein the pawl is rotatable within the radial bore between a first position and a second position such that the pawl transmits torque between the collar and the annular sleeve when the pawl is in the first position and the collar is rotated in the first direction, and wherein the pawl transmits torque between the collar and the annular sleeve when the pawl is in the second position and the collar is rotated in the opposite direction.

3. The ratchet operated device of claim 2 wherein the pawl overruns the annular series of teeth when the pawl is in the first position and the collar is rotated in the opposite direction, and wherein the pawl overruns the annular series of teeth when the pawl is in the second position and the collar is rotated in the first direction.

4. The ratchet operated device of claim 3 wherein the second position is angularly offset approximately 180 degrees from the first position.

5. The combination, comprising:

a post having an upper end, and a lower end with a helical auger suited for anchoring the post in the ground as the post is rotated about its longitudinal axis in a first direction, and to be removed form the ground as the post is being rotated in the opposite direction about said longitudinal axis, the post having a first pin-receiving opening spaced from the upper end of the post;

a sleeve having a second pin-receiving opening and an opening for removably receiving the upper end of the post to a position aligning the pin-receiving openings;

pin means receivable in the aligned pin-receiving openings for releasably connecting the sleeve non-rotatably to the post;

the sleeve having an annular series of ratchet teeth disposed about the longitudinal axis of the post;

shoulder means rigidly located on the sleeve and spaced from a first end of the sleeve and extending outwardly form the sleeve, said shoulder means and said sleeve having a radius, the radius of the sleeve between the first end and the shoulder means being less than the radius of said shoulder means;

a collar having a bore with a radius large enough to allow the collar to be slidably mounted on and removed from the first end of the sleeve and to move along the sleeve from the first end to the shoulder means so as to be rotatable with respect to the sleeve about the longitudinal axis of the post, the radius of the collar bore being smaller than the radius of the shoulder means, whereby pressure on the collar in a direction of the longitudinal axis of the post presses the collar against the shoulder means;

pawl means carried by the collar, the pawl means including a pawl receivable in the ratchet teeth to form a torque-transmitting connection between the collar and the post as the collar is being rotated in said first direction, and spring bias means carried by the collar for biasing the pawl toward the ratchet teeth, but permitting the pawl to be retracted from engagement with the ratchet teeth to a non-torque transmitting position as the collar is being rotated in the second direction so as to permit rotation of the collar with respect to the post; and handle means connected to the collar for rotating the collar about the longitudinal axis of the post in either said first direction or said second direction.

* * * * *